US006619331B1

(12) United States Patent
Suchdev

(10) Patent No.: US 6,619,331 B1
(45) Date of Patent: Sep. 16, 2003

(54) WATER DELIVERY TUBE ASSEMBLY

(76) Inventor: Jagan N. Suchdev, 8 Ruffled Feathers Dr., Lemont, IL (US) 60429

( * ) Notice: Subject to any disclaimer, the term of this patent is extended or adjusted under 35 U.S.C. 154(b) by 0 days.

(21) Appl. No.: 10/300,119

(22) Filed: Nov. 20, 2002

(51) Int. Cl.[7] ..... F16L 9/00

(52) U.S. Cl. ..... 138/177; 138/109; 138/118; 138/121

(58) Field of Search ..... 138/177, 178, 138/121, 118, 109

(56) References Cited

U.S. PATENT DOCUMENTS

| | | | | | |
|---|---|---|---|---|---|
| 4,320,783 | A | * | 3/1982 | Neal et al. | 138/110 |
| 4,508,065 | A | | 4/1985 | Suchdev | 123/41.35 |
| 4,650,224 | A | * | 3/1987 | Smith | 285/145.5 |
| 5,655,572 | A | * | 8/1997 | Marena | 138/125 |
| 5,762,108 | A | * | 6/1998 | Hunter | 138/109 |
| 5,803,128 | A | * | 9/1998 | Reed | 138/123 |
| 5,803,129 | A | * | 9/1998 | Coronado et al. | 138/125 |
| 5,899,236 | A | * | 5/1999 | Coronado et al. | 138/125 |
| 5,988,226 | A | * | 11/1999 | Matthews | 138/109 |
| 6,016,842 | A | * | 1/2000 | Rooke | 138/109 |
| 6,247,763 | B1 | * | 6/2001 | Rehn et al. | 303/30 |
| 6,302,152 | B1 | * | 10/2001 | Mulligan | 138/125 |
| 6,475,625 | B2 | * | 11/2002 | Muto et al. | 428/423.5 |
| 6,513,552 | B1 | * | 2/2003 | Shepherd | 138/109 |

OTHER PUBLICATIONS

Brochure from Power Parts Company (3 pages). Applicant submits that he was aware of the Power Parts products more than one year prior to the filing of the above–identified patent application.

* cited by examiner

*Primary Examiner*—Patrick Brinson
(74) *Attorney, Agent, or Firm*—Welsh & Katz, Ltd.; Eric D. Cohen

(57) ABSTRACT

A water delivery tube assembly for use in an internal combustion engine of a locomotive provides water between an inlet aperture of a power pack and an outlet aperture of a manifold where the inlet aperture and outlet apertures are longitudinally offset from each other and are disposed in misaligned planes. The assembly includes a flexible metal pipe having inlet and outlet ends and a metal braid surrounding the pipe. The inlet and outlet housings are operatively coupled to the inlet and outlet ends of the pipe, respectively and defme an internal fluid flow path in fluid communication with the pipe. The inlet and outlet housings have compound angles defining the fluid flow path such that when the inlet housing is secured to the power pack and the outlet housing is secured to the manifold, the flexible metal pipe is maintained in a substantially linear configuration between the housings.

19 Claims, 8 Drawing Sheets

WATER DELIVERY TUBE ASSEMBLY

FIELD OF THE INVENTION

The present invention relates generally to an apparatus for delivering water to an internal combustion engine and more specifically to a delivery tube assembly for providing cooling water between a power pack and a cooling manifold of a diesel-electric locomotive.

BACKGROUND

In the art relating to internal combustion engines, it is well known to provide piston cylinders having hollow interior portions that are cooled from a source of water supplied by various pipes and tubes. For example, heavy duty engines in locomotives are typically diesel engines that are used to generate electricity that power the electric motors, which electric motors provide the electromotive force to the wheels. Such diesel engines are water cooled, where water from a cooling manifold is supplied by rigid metal pipe to each "power pack" of the diesel engine. Each power pack contains a single cylinder and associated mechanicals and mounting structure, and a typical locomotive diesel engine may include sixteen such power packs for a "sixteen cylinder" engine. Accordingly, a sixteen cylinder engine would have sixteen metal cooling pipes connected to the manifold. Of course, such engines may have eight, twelve, sixteen or twenty cylinders, as is known in the art.

In a particular model of locomotive, the position of the power pack with respect to the manifold pipe is fixed within certain dimensional tolerances. Accordingly, the cooling pipe must have a specific configuration with respect to bends, its length, and the like, in order to be able to fit and connect between the power pack and the cooling manifold.

Such rigid metal pipes have been used for many years in locomotive applications. These known pipes have a curved portion and welded or brazed flanges at each end. The curve is required due to the relative positions of the outlet and inlet apertures on the manifold and the power pack, respectively and the distance separating the apertures. The flange securing the cooling pipe to the power pack is secured using two bolts, while the flange securing the cooling pipe to the manifold is typically secured using two U-shaped bolts, where the ends of each U-shaped bolt are threaded and are received through a pair of bolt holes in the flange and secured by corresponding nuts.

However, several problems are caused by the use of a rigid pipe. First, locomotive engines are not necessarily made to precision tolerances with respect to the position between the power pack and the manifold. When the flange bolts are tightened, the manifold may move slightly to permit a tight seal to be made between the flanges and the power pack and manifold, respectively. As the flange bolts are tightened, if any misalignment exists, the rigid cooling pipe and flange are stressed. The greater the misalignment or dimensional tolerance between power pack and the manifold, the greater the stress applied to the cooling pipe.

Further, as described above, several such rigid cooling pipes may be used, which are typically disposed along the manifold at equal intervals, depending of course, on the number of power packs in the engine. Because the manifold is essentially a long tube, it is secured at its ends, and may have supports along its length. Accordingly, the manifold is able to flex a certain amount.

Additionally, because the manifold is fixed at its ends, it may be able to flex more toward its midsection than it can at its endpoints or attachment mounting, where it is fixed. In some locomotive configurations, for example, for cooling pipes disposed toward the middle of the manifold, tightening the bolts on the flanges, while subjecting the cooling pipe and flange to stress, may only induce moderate stress, depending upon the misalignment between the manifold and the power pack for that particular engine. However, for cooling pipes disposed toward the ends of the manifold, the manifold is very stiff and does not easily move. When the flange bolts are tightened for such end-located cooling pipes, the rigid pipe and flange may be subject to much greater stress and torque. This may cause metal fatigue and stress fractures resulting in the destruction of the cooling pipe, necessitating repair and replacement prior to the normal lifetime of the cooling pipes.

Moreover, such locomotive diesel engines are large heavy-duty engines and generate significant amounts of vibration when in operation. Accordingly, there is significant vibratory motion between the components of the engine. This induces further stress in the rigid cooling pipe as the manifold and the power pack vibrate relative to each other, and such stress further reduces the normal lifetime of the cooling pipe.

Various attempts have been made to overcome the aforementioned shortcomings of rigid cooling pipes. One known attempt to overcome such problems is to replace the curved rigid cooling pipe with a curved flexible cooling pipe. Again, the curve is required to permit the cooling pipe to fit between the power pack and the manifold. Accordingly, it is known to replace the rigid pipe with a corrugated pipe made from, for example, thin-wall stainless steel. Corrugating the stainless steel pipe increases its flexibility and permits it to bend to some degree. To meet required structural integrity and strength requirements, the corrugated pipe is covered with a stainless steel wire braid. The braid typically increases the bursting strength of the pipe.

Although this known configuration using a corrugated stainless steel pipe and associated braid was an improvement over the rigid cooling pipe, it was found that the harsh operating environment of the locomotive engine, and in particular, the constant and significant vibration, causes the braid to rub or chafe against the underlying corrugated pipe. Over time, such chafing abraded the metal surface of the corrugated pipe until the corrugated pipe was breached. When this occurs, a leak develops, again necessitating replacement of the cooling pipe and removal of the locomotive from service for unscheduled maintenance. Surprisingly, the braid was found to breach the corrugated pipe in a short period of operation, significantly less than the expected lifetime of the cooling pipe. Again, this is relatively costly, not only from the point of view of replacement parts, but significantly, due to the operational cost associated with removing the locomotive from service for repair and premature maintenance.

Additionally, because the corrugated pipe was bent at an angle to accommodate attachment of the flanges to the power pack and manifold, respectively, the tight bend essentially rendered the corrugation very stiff at the "elbow," to a point where it behaves like a solid pipe. The braid is essentially "stretched" around the bend or elbow of the corrugated pipe, causing the braid to rub with even greater force against the corrugated pipe, especially at the outside bend of the corrugated pipe. This, in part, additionally contributed to the reduced lifetime of the corrugated pipe.

Another known configuration again uses a corrugated metal pipe with metal braid, which configuration is also curved. However, this configuration includes a Teflon liner inside the corrugated metal pipe, presumably to smooth out the fluid flow. Because a Teflon liner is used, the pipe cannot be welded or brazed, or otherwise be subject to high heat processing. The corrugated pipe and metal braid are therefore crimped into the flanges or housings to form the assembly. However, the crimp is adversely affected by the high levels of vibration, and fail prematurely. Thus, this known configuration is also unacceptable.

A need exists for a cooling pipe assemble for use in a locomotive diesel engine that can withstand the harsh operating environment and provide adequate lifetime.

SUMMARY

The disadvantages of present cooling water delivery systems may be substantially overcome by providing a novel cooling water delivery assembly. More specifically, in one embodiment, a water delivery tube assembly for use in an internal combustion engine of a locomotive provides water between an inlet aperture of a power pack and an outlet aperture of a manifold, where the inlet aperture and outlet aperture are longitudinally offset from each other and are disposed in misaligned planes. The assembly includes a flexible metal pipe having inlet and outlet ends, and a metal braid surrounding the pipe. Inlet and outlet housings are operatively coupled to the inlet and outlet ends of the pipe, respectively and defme an internal fluid flow path in fluid communication with the pipe. The inlet and outlet housings have compound angles defining the fluid flow path such that when the inlet housing is secured to the power pack and the outlet housing is secured to the manifold, the flexible metal pipe is maintained in a substantially linear configuration between the housings.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION

In this written description, the use of the disjunctive is intended to include the conjunctive. The use of definite or indefinite articles is not intended to indicate cardinality. In particular, a reference to "the" object or thing or "an" object or "a" thing is intended to also describe a plurality of such objects or things.

Figure 1:
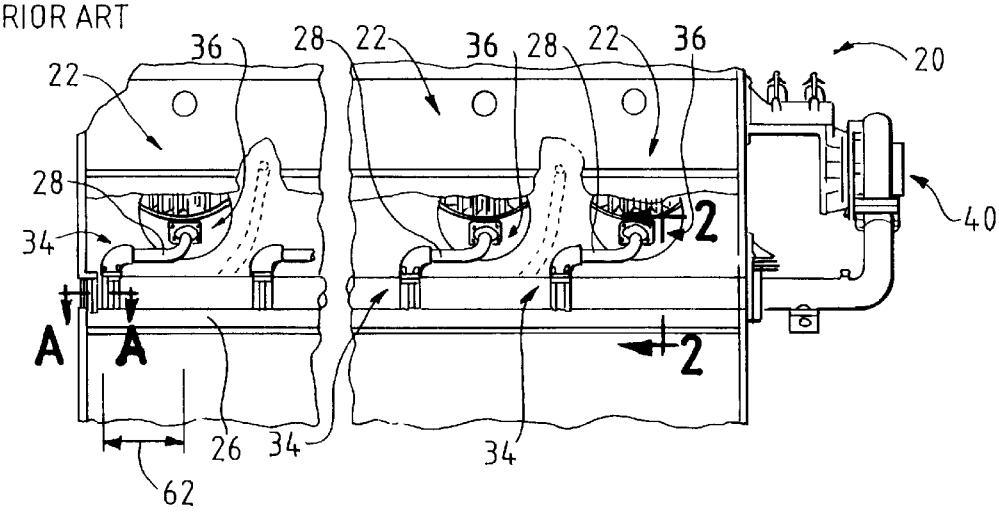
FIG. 1 PRIOR ART
FIG. 1 is a side elevational cut-away view of a prior art locomotive diesel engine showing a power pack, manifold, and known cooling pipe arrangement.
Figure 2:
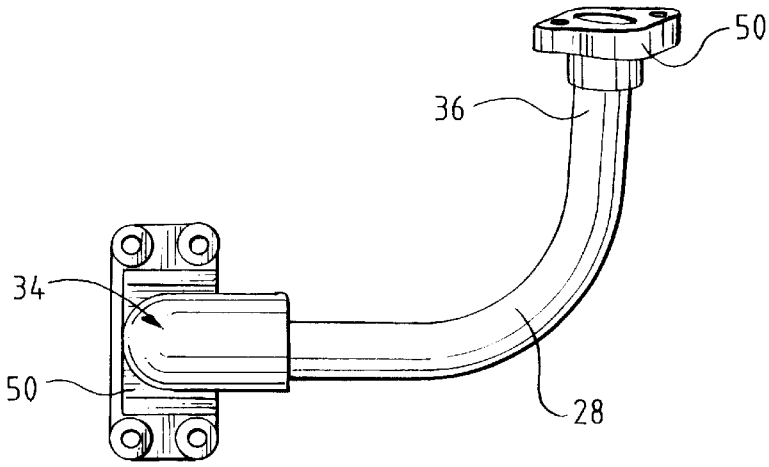
FIG. 2 PRIOR ART
FIG. 2 is a perspective view of the known cooling pipe of FIG. 1.
Figure 3:
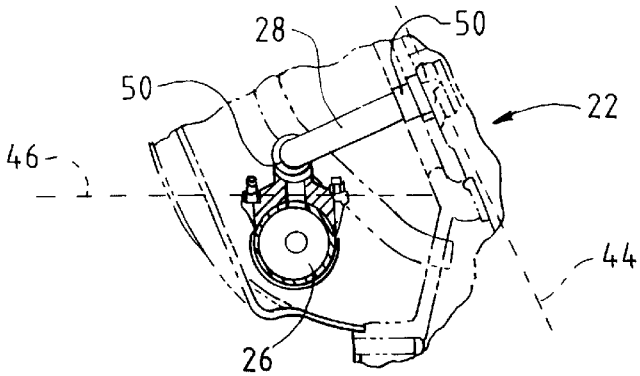
FIG. 3 PRIOR ART
FIG. 3 is an end elevational view of the known power pack and manifold of FIG. 1 taken along the line 2—2 of FIG. 1.

Referring now to FIGS. 1–3, FIGS. 1 and 3 show a known locomotive diesel engine 20. In FIG. 1, three power packs 22 or "cylinder blocks" of the engine 20 are shown. A manifold 26 in the form of a tube provides cooling water to the power pack 26 via an S-shaped rigid metal pipe 28. FIG. 2 shows a perspective view of the known rigid pipe 28. An outlet end 34 of the rigid metal pipe 28 is connected to the manifold 26 while an inlet end 36 of the rigid metal pipe is connected to the power pack 22. The rigid metal pipe 28 must be S-shaped because the connection point to the manifold 26 is longitudinally offset from the connection point of the power pack 22. A water pump 40 circulates the water, as is known in the art. The direction of water flow, whether in or out of a particular end of the pipe, is immaterial to the scope of this invention.

As shown in the side view of FIG. 3, a plane 44 of the power pack 22 is not in alignment with a plane 46 of the manifold 26. The S-shaped rigid metal pipe 28 with associated flanges 50 must be machined exactly so that it fits precisely between the power pack 22 and the manifold 26. Any error in the dimensioning of the flanges 50 of the pipe 28 or relative "twisting" angles between the flange and the pipe may result in the inability to use the part in an existing locomotive engine for which it was intended. As described above, the locomotive engine 20 may have dimensional variation between placement and configuration of the manifold 26 and the power pack 22 such that when the bolts fastening the flanges are tightened, the pipe 28 and flanges 50 may be subject to significant stress or torque. Note that the curve or S-shape of the rigid metal pipe cannot be easily seen in the view of FIG. 3.

Figure 4:
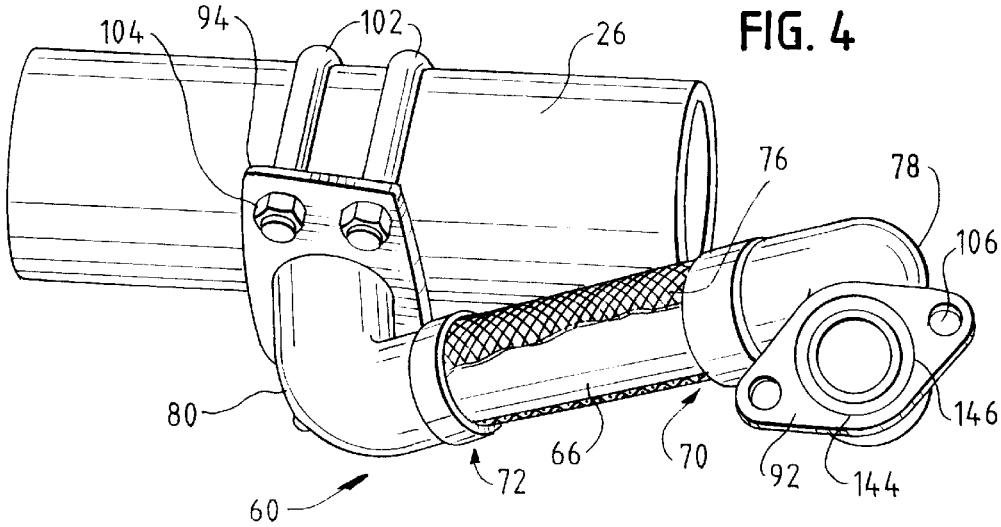
FIG. 4 is a perspective view of a specific embodiment of a water delivery tube assembly according to the present invention.
Figure 4A:
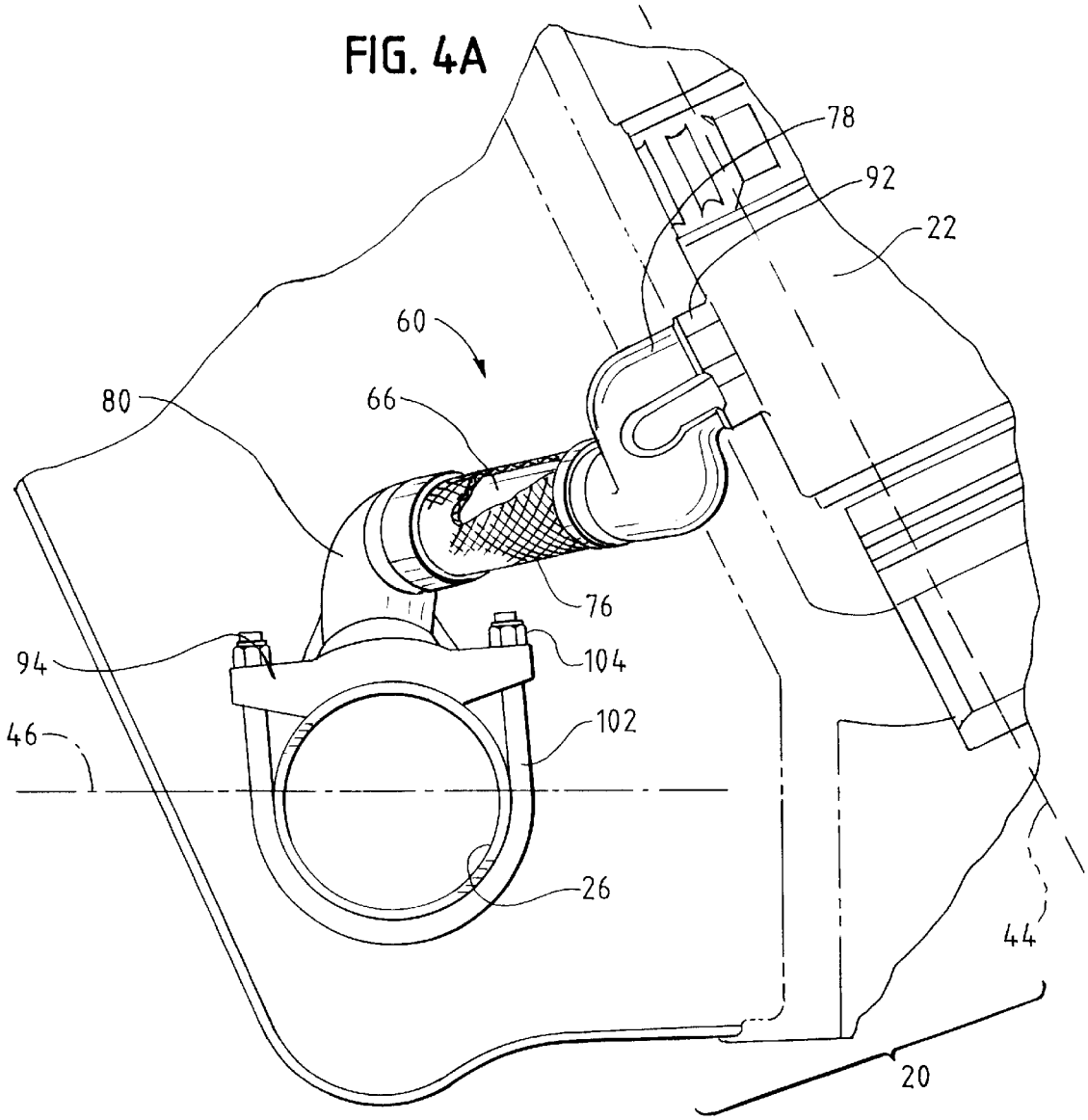
FIG. 4A is an end elevational view of the known engine environment showing the cooling tube assembly according to the present invention connected between the known power pack and known manifold, taken along the line 2—2 of FIG. 1.

Referring now to FIGS. 1, 4 and 4A, a perspective view of a cooling pipe assembly 60 according to the present invention is shown coupled to the manifold 26 of FIGS. 1–3. The present invention 60 is intended to replace the known rigid pipe assembly 28 (FIG. 2), and may be configured to fit between and be secured to the power pack 22 and manifold 26 in a specific model of locomotive engine, as shown in FIG. 4A. FIG. 1 (prior art) will be used in conjunction with FIG. 4A herein, and like reference numbers will be used to denote like structures, because both FIGS. 1 and 4A shown the environment in which the present invention 60 may be used.

For example, the present invention 60 may be used in a General Motors Model 710G3 locomotive engine 20. As such, the cooling water delivery assembly 60 must couple the inlet aperture of the power pack 22 with the outlet aperture of the manifold 26 to permit fluid flow therebetween to effect cooling of the engine. As more clearly shown in FIG. 1, the inlet aperture of the power pack is longitudinally offset from the outlet aperture of the manifold, as shown by an arrow 62, and the respective mounting planes 44, 46 (FIG. 4A) are not aligned. Thus, a complex shape must be utilized to connect the two apertures in a specific locomotive model.

Figure 5:
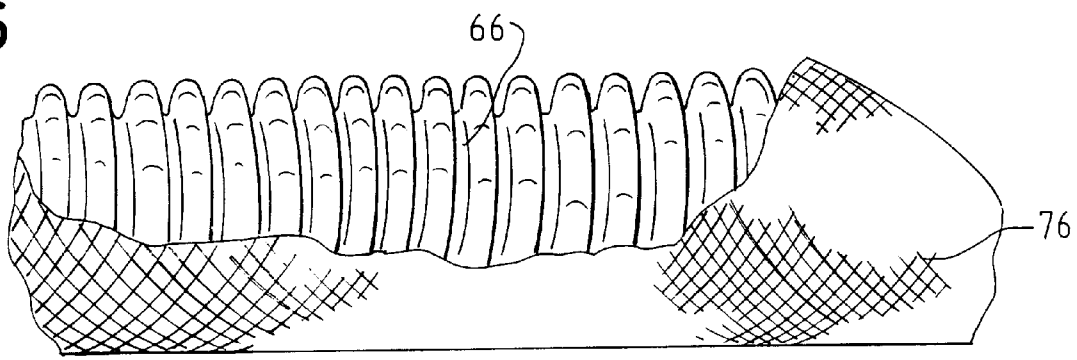
FIG. 5 is a cut-away sectional view of a segment of a known corrugated metal pipe and surrounding stainless steel wire braid.
Figure 6:
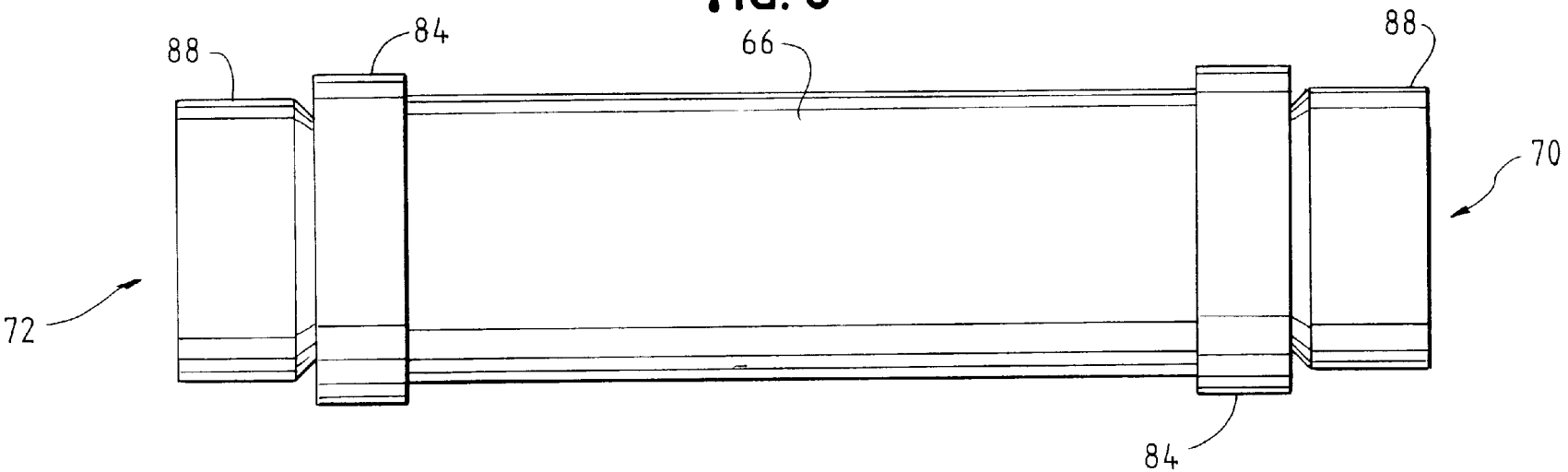
FIG. 6 is a side elevational view of the pipe and braid segment of FIG. 5 shown with attached collars and spacers.

Referring now to FIGS. 4, and 4A–6, the cooling pipe assembly 60 includes a flexible metal pipe 66 having an inlet end 70 and an outlet end 72, a metal braid 76 surrounding the pipe, and an inlet housing 78 and outlet housing 80 operatively coupled to the inlet and outlet ends of the pipe 70, 72 respectively. The metal pipe 66 is preferably formed of corrugated metal, such as thin wall stainless steel, as best shown in FIG. 5. Note that for purposes of illustration only, FIG. 4 shows the flexible metal pipe in "solid modeling format," and neither the metal braid nor the corrugation are particularly discernable. Such corrugated metal pipe 66 with stainless steel wire braid 76 is commercially available, with a set of collars 84 and spacers 88 attached thereto, as shown in FIG. 6. The metal braid 76 increases the bursting strength of the corrugated pipe 66. The collars 84 are provided so that the corrugated metal pipe 66 and braid 76 can be welded into an integral structure. The collars 84 are then welded with the spacers 88, where the spacers then permit the pipe 66 and braid 76 to be welded as an integral unit to the respective housings 78, 80.

FIGS. 7A–7E are further perspective drawings of the cooling pipe assembly 60 shown from different angles to illustrate specific angles between the pipe 66 and the housings 78, 80. Note that for purposes of illustration only, FIGS. 7A–7E are shown as line drawings, again, neither particularly showing the metal braid nor the corrugation of the metal pipe 66. Note that the figures may or may not show the metal braid 76 in all views, and that the pipe, although labeled as numeral 66, is meant to include the braid 76.

Figure 7A:
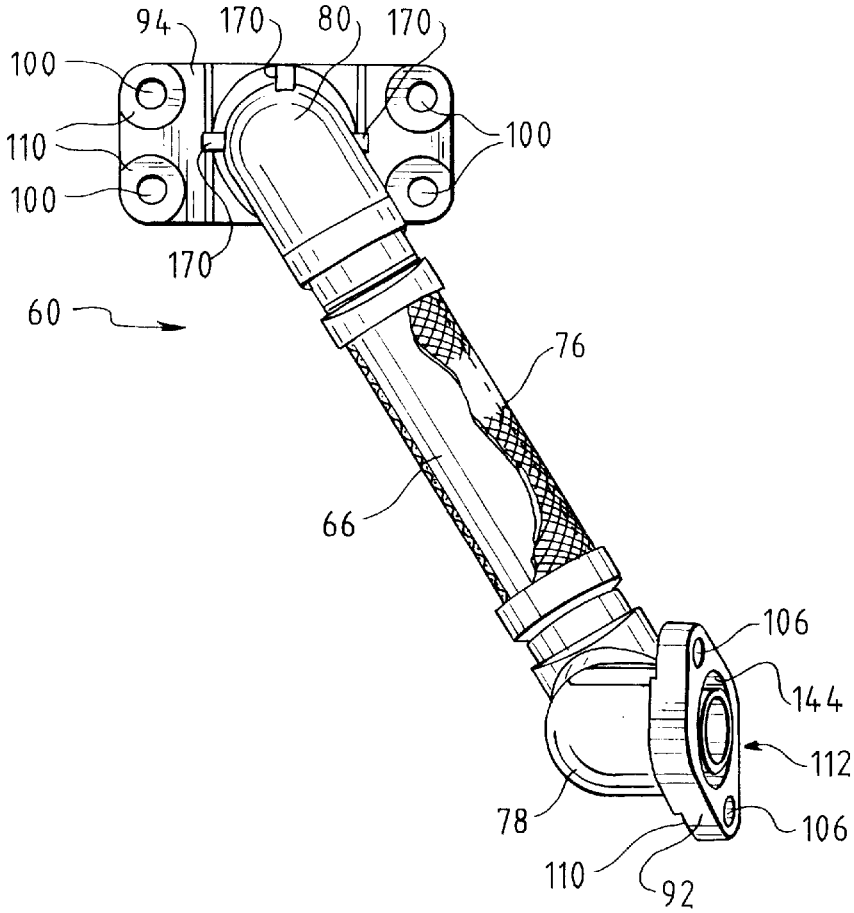
FIGS. 7A–7E are perspective sectional line drawings of a specific embodiment of the assembly of FIG. 4.
Figure 7B:
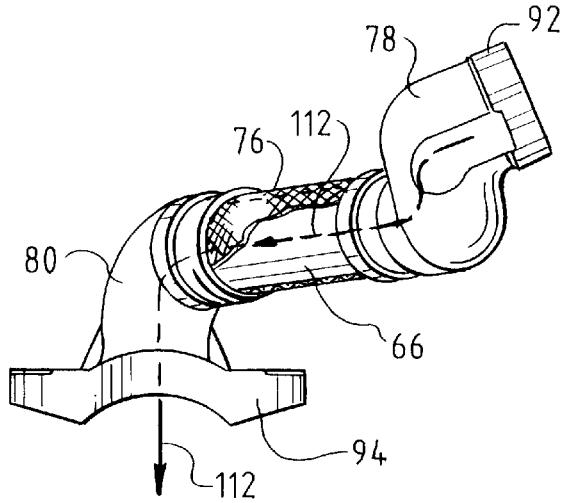
Figure 7C:
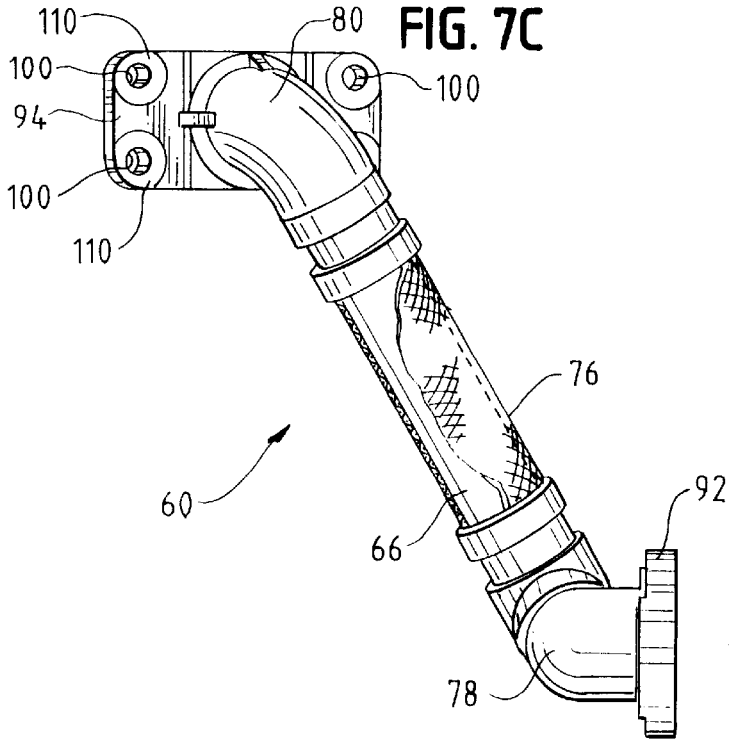
Figure 7D:
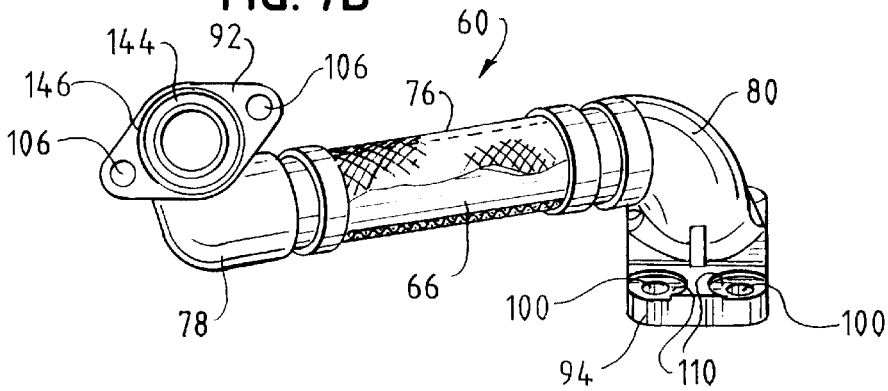
Figure 7E:
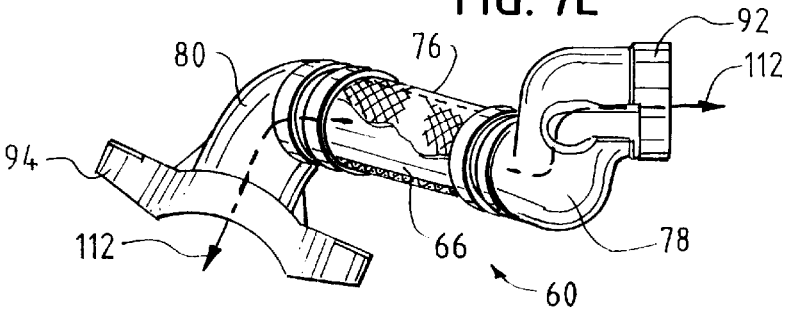

The inlet and outlet housings 78, 80 each include a mounting flange 92, 94 integrally formed with the housings 78, 80. As more clearly shown in FIGS. 7A, 7C and 7D, the mounting flange 94 of the outlet housing 80 may include, for example, four apertures 100 for receiving mounting bolts therethrough. The outlet housing mounting flange 94 may be secured to the manifold 26 by two U-shaped bolts 102 (FIG. 4), the ends of which are received through the apertures and may be fastened with nuts 104. Similarly, as best shown in FIGS. 7A and 7D, the mounting flange 92 of the inlet housing 78 may include, for example, two apertures 106 for receiving mounting bolts therethrough. The top surface portion that circumscribes the apertures of each flange 92, 94 may be countersunk 110 to accommodate the head of the bolt or a locking washer.

The flanges 92, 94 and the respective housings 78, 80 define an internal fluid flow path that is in fluid communication with the metal pipe 66. This permits the cooling water to be transferred between the manifold 26 and the power pack 22. The inlet and outlet housings 78, 80 have compound angles that define the fluid flow path such that when the inlet housing is secured to the power pack 22 via its flange 92, and the outlet housing is secured to the manifold 26 via its flange 94, the flexible metal pipe 66 is maintained in a substantially linear configuration between the housings. This is an important consideration, because as described above with respect to the prior art, if the corrugated pipe 66 and braid 76 are bent, the harsh environment, including the significant vibration, causes the metal braid to wear away the corrugated pipe.

Because the corrugated pipe 66 and braid 76 are maintained in a substantially linear configuration between the housings 78, 80, the vibration in the operating environment does not cause the braid to abraid the corrugated pipe, thus the normal lifetime of the cooling pipe assembly 60 is not compromised. Because the corrugated pipe 66 is maintained in a substantially straight or linear configuration, all of the angular bends are accounted for in the configuration of the housings 78, 80. Of course, due to tolerance errors between the manifold 26 and the power pack 22 and normal production variations, as described above, when the flanges 92, 94 are secured to the manifold and power pack, respectively, the corrugated pipe 66 will bend to a very slight degree to accommodate such tolerance errors. However, it is still substantially straight.

Thus, while the corrugated pipe 66 is maintained in a substantially linear configuration, it is not necessarily maintained in an absolutely linear configuration, as no product is "absolutely" straight. There may always be some variation, even if it is not measurable. In the present invention, the amount of deviation from a linear configuration accommodates the vibratory motion of the components and the normal misalignment of the locomotive engine components, namely, the power pack 22 and the manifold 26.

Although the inlet housing 78 and the outlet housing 80 include several compound bends, the internal passageway 112 of the housings are maintained at a substantially constant inner diameter relative to a centerline of the fluid flow. If the internal diameter were to vary, the portions having a reduced internal diameter would cause undesirable back pressure in the fluid flow, and could negatively impact the cooling system of the engine 20.

Referring now to FIGS. 8A–G, the inlet housing 78 is shown from various angles. The inlet housing 78 is a single piece of casting (for example, steel bronze, brass, and the like), and the compound angles of the different sections form a generally S-shaped path. The inlet housing 78 includes the inlet flange 92, a first section 122, a second section 124, and third section 126, all integrally formed so as to define the internal fluid flow path. As described above, the internal fluid flow path is maintained at a substantially constant internal diameter through the three sections 122, 124, 126 and the flange 92 to maintain constant dynamic fluid mechanic properties.

The first section 122 integrally formed with the flange 92, the third section 126 is operatively coupled to the inlet end 36 of the pipe 66, and the second section 124 is formed between the first and third sections 122, 126. As is known in the art, the third section 126 may be welded or brazed to the inlet end 36 of the pipe 66. Specifically, the third section 126 is welded or brazed to the spacer 88 (FIG. 6.) at the inlet end 36 of the corrugated pipe 66.

Figure 8A:
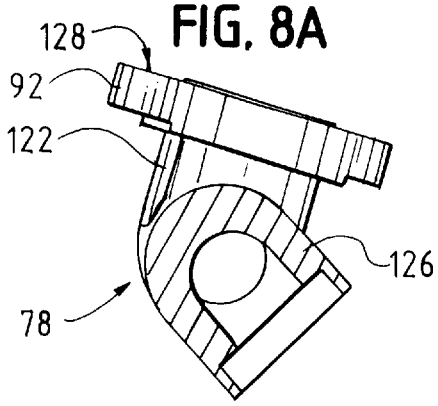
FIGS. 8A–8G are perspective sectional line drawings of a specific embodiment of an inlet housing.
Figure 8B:
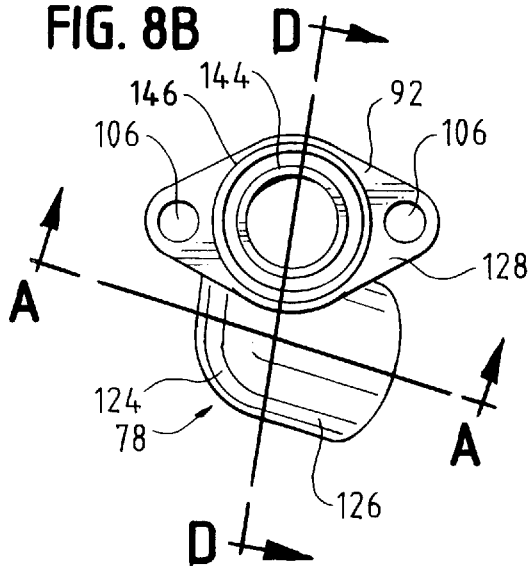

The first section 122 is axially aligned or "in-line" with a face of the flange 128, as more clearly shown in FIGS. 8A–8B. The second section 124 is then disposed at about a ninety-nine degree angle 130 relative to the first section 122, as more clearly shown in FIG. 8C. Preferably, the angle 130 between the first and second sections 122, 124 is 99.478 degrees. The third section 126 is then disposed at about a ninety-nine degree angle 132 relative to the second section 124, as more clearly shown in FIG. 8D. Preferably, the angle 132 between the second and third sections 124, 126 is 99.360 degrees.

Additionally, the third section 126 is rotated away from the plane of the flange face 128 by about a thirty-one degree angle 134. Preferably, the third section 126 is rotated away from the plane of the flange face 128 by a 31.146 degree angle 134, as more clearly shown in FIG. 8E.

Figure 8C:
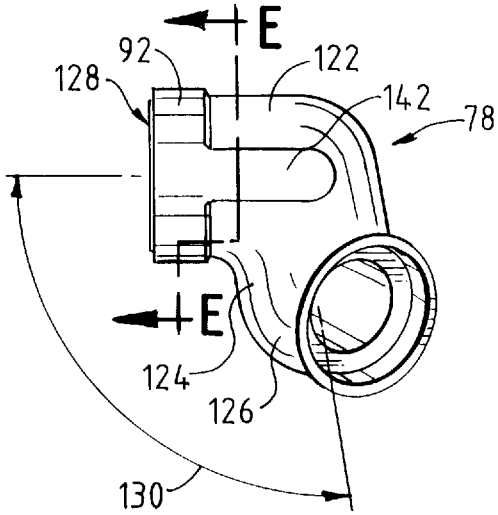
Figure 8D:
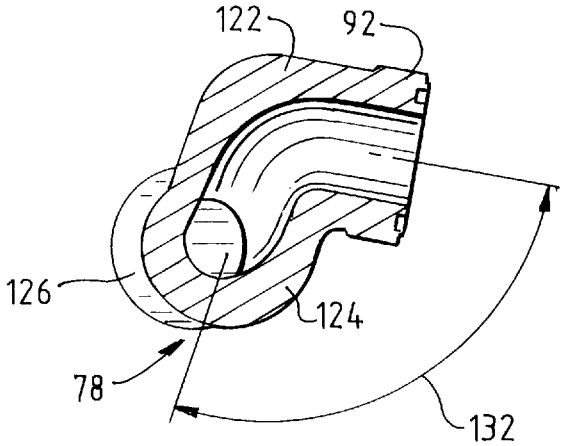
Figure 8E:
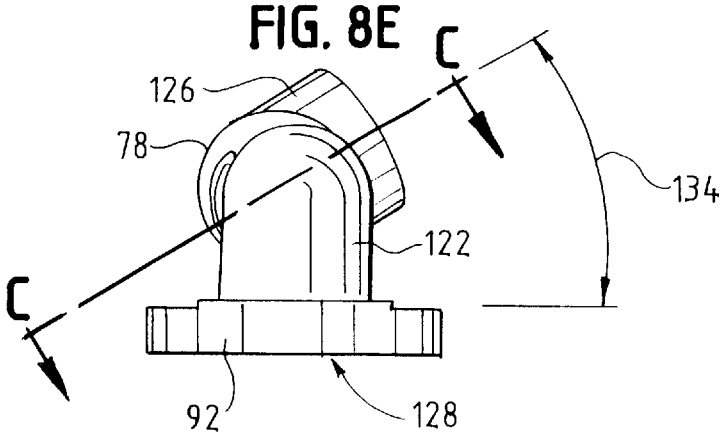
Figure 8F:
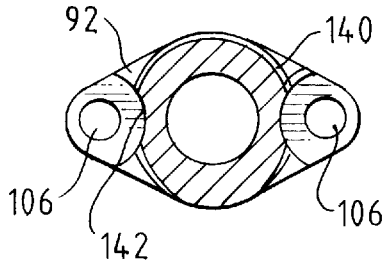
Figure 8G:
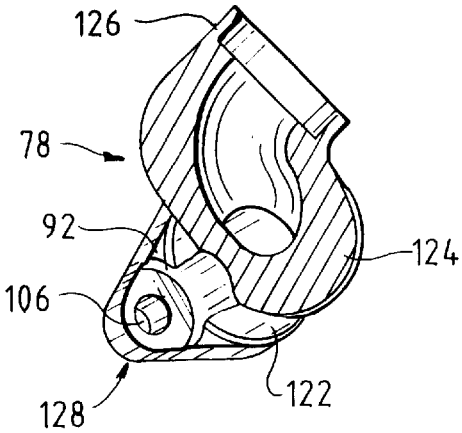

As described above with respect to FIG. 7D, the flange 92 of the inlet housing 78 may include the two mounting apertures 106 configured to receive bolts therethrough to secure the inlet housing to the power pack 22. The mounting apertures 106 are axially aligned with the first section 122 but are juxtaposed laterally from the first section 122. As clearly shown in FIG. 8F, the first section 122 defines a cylindrical sidewall 140. The cylindrical sidewall 140 may have a flattened portion or a bored-out portion 142 in the vicinity of the mounting apertures 106, as shown in FIGS. 8C and 8F. Because the cooling pipe assembly 60 is designed to interface with an existing locomotive engine 20, the placement of the mounting holes 106 is dictated by the manufacturer, and thus, the distance between the two mounting holes is fixed.

However, the diameter of the first section 122 and the thickness of the walls of the first section is also dictated by structural considerations. Accordingly, the edge of the cylindrical sidewall 140 is in close proximity to the mounting holes 106. When a bolt is received though the mounting hole 106, the head of the bolt may be fairly close to the cylindrical sidewall 140. During conventional maintenance, the bolts are preferably tightened using a socket rather than a wrench. Accordingly, the flattened or bored-out portion 142 provides the cylindrical sidewall 140 with a reduced diameter at that point to provide additional lateral clearance between the cylindrical side wall of the first section 122 and the head of a bolt sufficient to accommodate use of a socket to tighten the bolt. This reduces maintenance costs.

Referring now to FIGS. 4, 7A, 7D, and 8B, an annular groove 144 is shown integrally formed in a face of the inlet housing flange 92. The annular groove 144 is configured to receive an O-ring so that when the inlet housing flange 92 is secured to the power pack 22, the O-ring compresses creating a water-tight seal. Further, an integrally formed upstanding annular ring 146 circumscribes an outer diameter of the groove 144 and projects for a short distance beyond the face of the mounting flange 92. The annular ring 146 may be protrude, for example, about 1/32 of an inch beyond the face of the mounting flange 92. This functions to retain the O-ring in place and prevent "spreading" of the O-ring should the mounting flange 92 be tightened with too much force.

Note that the O-ring is a standard commercially available O-ring of the same type used in the known cooling pipe configuration. Thus, the present inventive cooling pipe assembly 60 can directly replace and be substituted for existing assemblies in the engine 20 without using any additional components.

Referring now to FIGS. 9A–D, the outlet housing 80 is shown from various angles. The outlet housing 80 is also formed from a single piece of casting. The outlet housing 80 includes the outlet flange 94, and a curved section 150 having a first end 152 and a second end 154 that define the internal fluid flow path. Again, as described above, the internal fluid flow path is maintained at a substantially constant internal diameter to maintain constant dynamic fluid properties.

Figure 9A:
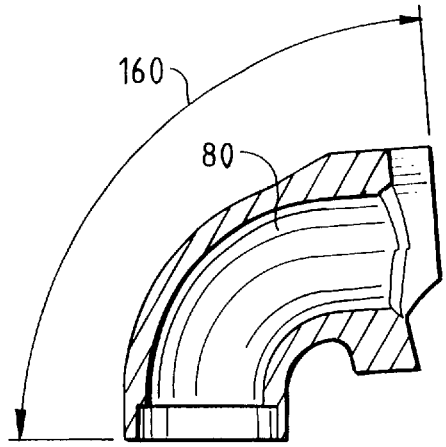
FIGS. 9A–9D are perspective sectional line drawings of a specific embodiment of an outlet housing.

The first end 152 is integrally formed with the flange 94, and the second end 154 is operatively coupled to the outlet end 34 of the pipe 66 by welding or brazing, for example, as described above. The radius of curvature of the curved section 150 extends through an angle of about eight-six degrees 160, and preferably through an angle of 85.84 degrees, as best shown in FIG. 9A. Because the angle of curvature 160 is not exactly ninety degrees, the second end 154 of the curved section, which is straight, is disposed at about a four degree angle 162 relative to the plane of the flange 94. Preferably, the angle 162 between the second end 154 and the plane of the flange 94 is 4.16 degrees, as best shown in FIG. 9B.

Additionally, the curved section 150 may be rotated about an axis normal to the plane of the flange face 92 by about a thirty-one degree angle 166. Preferably; the angle 166 is 30.86 degrees, as best shown in FIGS. 9C–9D.

Figure 9B:
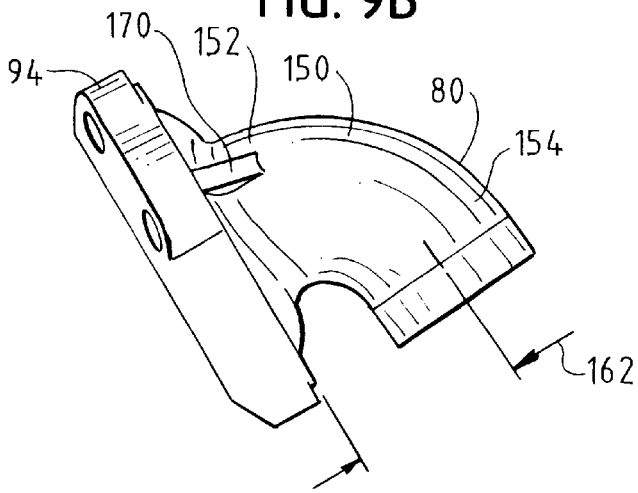
Figure 9C:
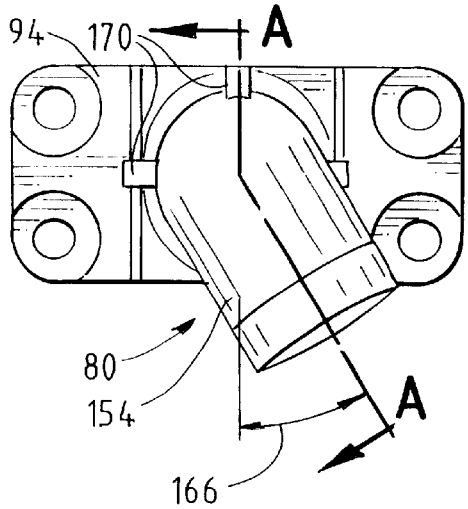
Figure 9D:
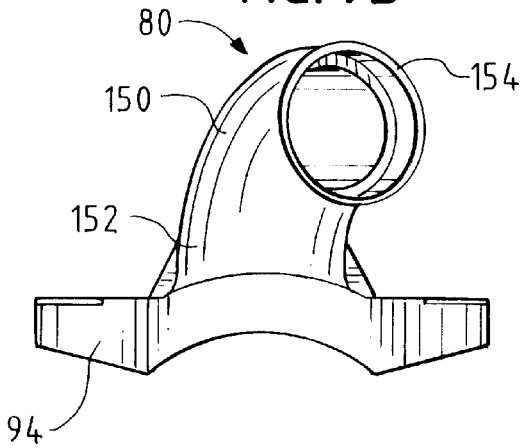

As best shown in FIGS. 7A, 9B–9C, the outlet housing 80 may further include a plurality of support ribs 170 disposed between the mounting flange 94 and the first end 152 of the curved section 150. Preferably, three ribs 170 are included. The ribs 170 provide additional strength and structural support, which permit the thickness of the flange 94 to be reduced compared to the prior art flange of the rigid cooling pipe of FIG. 2.

Note that as mentioned above, the inlet and outlet housings 78, 80 are formed from castings, and thus may be welded or brazed. The prior art rigid cooling tube was formed of steel, but the outlet elbow was made from cast iron and required brazing to secure it to the rigid pipe. The dimensional tolerances of the prior art rigid cooling tube assembly must be very close to successfully perform brazing. This increases manufacturing costs for the prior art rigid pipe assembly. In the present invention, the housings 78, 80 are formed using a precision casting process, which eliminates or minimizes the need for machining of the housings or the flanges 92, 94.

Because the cooling pipe assembly 60 is flexible and essentially in a linear configuration, it is very easy to install or retrofit in the engine 20. In contrast, the known rigid pipe assembly 28 requires that the bolts on the flanges 50 be tightened sequentially, without fully tightening one bolt before the others are in a similar torqued state. This means that the maintenance personnel must tighten the bolts on the flanges 50 in a "back-and-forth" manner, which is inefficient and thus costly. In the present cooling pipe assembly 60, however, because the cooling pipe assembly is flexible, the bolts on one flange can be fully tightened before the bolts on the other flange are tightened. This makes installation of the cooling pipe assembly 60 very efficient and cost effective.

Specific embodiments of a cooling pipe assembly according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A cooling water delivery tube assembly for use in an internal combustion engine of a locomotive to provide water between an inlet aperture of a power pack and an outlet aperture of a manifold, the inlet aperture and outlet apertures longitudinally offset from each other and disposed in misaligned planes, the assembly comprising:

a corrugated metal pipe having inlet and outlet ends;

a metal braid surrounding the pipe;

inlet and outlet housings operatively coupled to the inlet and outlet ends of the pipe, respectively;

mounting flanges integrally formed with each housing, respectively, the flanges having a mounting face;

the inlet and outlet housings defining an internal fluid flow path in fluid communication with the pipe;

the inlet and outlet housings having compound angles defining the fluid flow path such that when the inlet housing is secured to the power pack and the outlet housing is secured to the manifold, the corrugated metal pipe is maintained in a substantially linear configuration between the housings;

the inlet housing including first, second, and third integrally formed sections defining the internal fluid flow path, the first section integrally formed with the flange, the third section operatively coupled to the inlet end of the pipe, and the second section formed between the first and third sections, wherein the first section is axially aligned with the face of the flange, the second section is disposed at about a ninety-nine degree angle relative to the first section, the third section is disposed at about ninety-nine degree angle relative to the second section, and the third section being rotated at about a thirty-one degree angle away from the plane of the flange face; and the outlet housing including a curved section having first end and second straight ends defining the internal fluid flow path, the first section integrally formed with the flange and the second end operatively coupled to the outlet end of the pipe, wherein the radius of curvature of the curved section extends through an angle of about eight-six degrees such that the second straight end is disposed at about a four degree angle relative to a plane of the flange, and the curved section being rotated at about a thirty-one degree angle about an axis normal to the plane of the flange face.

2. A cooling water delivery tube assembly for use in an internal combustion engine of a locomotive to provide water between an inlet aperture of a power pack and an outlet aperture of a manifold, the inlet aperture and outlet apertures longitudinally offset from each other and disposed in misaligned planes, the assembly comprising:

a corrugated metal pipe having inlet and outlet ends;

a metal braid surrounding the pipe;

inlet and outlet housings operatively coupled to the inlet and outlet ends of the pipe, respectively; mounting flanges integrally formed with each housing, respectively, the flanges having a mounting face;

the inlet and outlet housings defining an internal fluid flow path in fluid communication with the pipe; and the inlet and outlet housings having compound angles forming a serpentine shape defining the fluid flow path such that when the inlet housing is secured to the power pack and the outlet housing is secured to the manifold, the corrugated metal pipe is maintained in a substantially linear configuration between the housings.

3. A water delivery tube assembly for use in an internal combustion engine of a locomotive to provide water between an inlet aperture of a power pack and an outlet aperture of a manifold, the inlet aperture and outlet apertures longitudinally offset from each other and disposed in misaligned planes, the assembly comprising:

a flexible metal pipe having inlet and outlet ends;

a metal braid surrounding the pipe;

inlet and outlet housings operatively coupled to the inlet and outlet ends of the pipe respectively;

the inlet and outlet housings defining an internal fluid flow path in fluid communication with the pipe;

the inlet and outlet housings having compound angles defining the fluid flow path such that when the inlet housing is secured to the power pack and the outlet housing is secured to the manifold, the flexible metal pipe is maintained in a substantially linear configuration between the housings; and the compound angles of the inlet housing having a generally S-shaped path.

4. The assembly according to claim 3 wherein the internal fluid flow path maintains a substantially constant internal diameter through said compound angles of the housings.

5. The assembly according to claim 4 wherein the substantially constant internal diameter minimizes water flow pressure drop in fluid flow through the housings.

6. The assembly according to claim 3 wherein each housing further includes a mounting flange integrally formed with the housing, the flange having a mounting face.

7. The assembly according to claim 6 wherein the inlet housing includes first, second, and third integrally formed sections defining the internal fluid flow path, the first section integrally formed with the flange, the third section operatively coupled to the inlet end of the pipe, and the second section formed between the first and third sections.

8. The assembly according to claim 7 wherein the first section is axially aligned with the face of the flange, the second section is disposed at about a ninety-nine degree angle relative to the first section, the third section is disposed at about ninety-nine degree angle relative to the second section, and the third section being rotated-at about a thirty-one degree angle away from the plane of the flange face.

9. The assembly according to claim 6 wherein the outlet housing includes a curved section having first end and second ends defining the internal fluid flow path, the first end integrally formed with the flange and the second end operatively coupled to the outlet end of the pipe.

10. The assembly according to claim 9 wherein the radius of curvature of the curved section extends through an angle of about eighty-six degrees such that the second end is disposed at about a four degree angle relative to a plane of the flange, and the curved section being rotated at about a thirty-one degree angle about an axis normal to the plane of the flange face.

11. The assembly according to claim 3 wherein each housing further includes a mounting flange integrally formed with the housing.

12. The assembly according to claim 11 further including a plurality of support ribs disposed between the mounting flange and the first end of the outlet housing.

13. The assembly according to claim 11 wherein the inlet housing flange includes a plurality of mounting apertures in juxtaposed axial alignment with the first section, the first section defining a cylindrical sidewall.

14. The assembly according to claim 13 wherein the cylindrical side wall includes flattened portion or bored portion of reduced diameter to provide lateral clearance between the side wall and a bolt received through the mounting aperture.

15. The assembly according to claim 11 further including an annular groove integrally formed in a face of the inlet housing flange, the annular groove configured to receive an O-ring.

16. The assembly according to claim 15 further including an upstanding annular ring circumscribing an outer diameter of the groove, the upstanding ring projecting for a short distance beyond the face of the mounting flange.

17. The assembly according to claim 3 wherein the first and second housings are formed of single casting.

18. The assembly according to claim 17 wherein the casting process minimizes machining of the housings.

19. The assembly according to claim 17 Wherein the flexible pipe is formed of corrugated metal.

* * * * *